US006880548B2

(12) United States Patent
Schultz et al.

(10) Patent No.: US 6,880,548 B2
(45) Date of Patent: Apr. 19, 2005

(54) WARM AIR FURNACE WITH PREMIX BURNER

(75) Inventors: Michael W. Schultz, Elk River, MN (US); Rolf L. Strand, Crystal, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/459,795

(22) Filed: Jun. 12, 2003

(65) Prior Publication Data

US 2004/0250810 A1 Dec. 16, 2004

(51) Int. Cl.[7] ..... F24H 3/02

(52) U.S. Cl. ..... 126/110 R; 126/112; 126/116 R; 431/354

(58) Field of Search ..... 126/110 R, 99 R, 126/116 R, 99 A, 99 C, 112, 92 AC; 431/350, 431/354, 326, 355, 328

(56) References Cited

U.S. PATENT DOCUMENTS 2,333,602 A * 11/1943 Almelo ..... 431/28
2,418,208 A 4/1947 Walker
2,843,108 A * 7/1958 Campbell et al. ..... 126/110 B
3,080,912 A 3/1963 Winter
3,526,367 A 9/1970 Trihey
3,905,752 A * 9/1975 Miller ..... 431/183
4,238,185 A 12/1980 Watson (Continued)

FOREIGN PATENT DOCUMENTS

GB 1 597 220 9/1981
GB 2224824 * 5/1990
JP 362080417 A 4/1987

OTHER PUBLICATIONS

"45.801.190- 1:1 Gas/Air Regulator Assembly Gas Controls", Honeywell Brochure, Jun. 2002, pp. 1-8.

(Continued)

*Primary Examiner*—James C. Yeung

(57) ABSTRACT

A warm air furnace system has a valve for controlling the flow of fuel, and a mixing component for receiving fuel from the valve and mixing the fuel with air to form an air-fuel premix. The warm air furnace system also has a burner assembly for receiving the air-fuel premix from the mixer, and an inducer for pulling the air-fuel premix through the burner assembly. The air-fuel premix drawn from the burner assembly is ignited into a flame by an ignition element. The flame transfers heat to a heat exchanger in communication with and positioned between the burner assembly and the inducer. The heat exchanger, in turn, transfers heat to air being passed over the heat exchanger by a circulation fan. The heated air passed over the heat exchanger then provides heat to a user of the furnace.

19 Claims, 11 Drawing Sheets

U.S. PATENT DOCUMENTS

| | | | | |
|---|---|---|---|---|
| 4,255,123 | A * | 3/1981 | Bishilany et al. | 431/328 |
| 4,329,139 | A | 5/1982 | Shinozaki et al. | |
| 4,607,787 | A | 8/1986 | Rogers, III | |
| 5,520,533 | A | 5/1996 | Vrolijk | |
| 5,590,642 | A | 1/1997 | Borgeson et al. | |
| 5,796,234 | A | 8/1998 | Vrionis | |
| 5,833,449 | A | 11/1998 | Knight et al. | |
| RE36,743 | E | 6/2000 | Ripka | |
| 6,133,699 | A | 10/2000 | Vrionis et al. | |
| 6,293,786 | B1 * | 9/2001 | Lasagni et al. | 431/354 |
| 2003/0101983 | A1 * | 6/2003 | Specht | 126/110 R |

OTHER PUBLICATIONS

"CVI-vf Integrated 1:1 Gas/Air Control Safety System with venturi and fan", Honeywell Brochure, Feb. 1996, pp. 1-4.

"45.900.444-/45.900.446- Venturi Manifold for VK41.5V/VK81.5V Gas Controls", Honeywell Brochure, Jan. 2001, pp. 1-10.

"VK41../VK81.. Series Gas Controls for Combined Valve and Ignition System", Honeywell Brochure, Apr. 2002, pp. 1-42.

* cited by examiner

WARM AIR FURNACE WITH PREMIX BURNER

FIELD

The present invention relates generally to warm air furnaces, and more particularly, to a premix inshot burner in a warm air furnace.

BACKGROUND

Many houses and other buildings use warm air furnaces to provide heat. Generally, these furnaces operate by heating air received through cold air or return ducts and distributing the heated air throughout the building using warm air or supply ducts. A circulation fan directs the cold air into a heat exchanger, which may be composed of metal. The heat exchanger metal is heated using a burner that burns fossil fuels. The burner is ignited with an ignition device, such as an AC hot surface ignition element. The air is heated as it passes by the hot metal surfaces of the heat exchanger. After the air is heated in the heat exchanger, the fan moves the heated air through the warm air ducts. A combustion air blower, or inducer, is used to remove exhaust gases from the building.

Warm air furnaces can be complex and costly to both manufacture and assemble. One reason for this complexity and high cost is the large number of components used in a warm air furnace. As a result of the large number of components, warm air furnaces can breakdown and become unreliable. Such unreliability can also result in unsafe operating conditions, which can be particularly harmful since a fuel (e.g., natural, propane or butane gas) is typically utilized in a warm air furnace. Because furnaces play a critical role in the comfort of the occupants of the building, it is also important that the warm air furnace remains functional and provides efficient heat.

Therefore, it is desirable to provide a reduced-cost warm air furnace that improves on the reliability, functionality, and safety of prior art warm air furnaces.

BRIEF DESCRIPTION OF THE DRAWINGS

Presently preferred embodiments are described below in conjunction with the appended drawing figures, wherein like reference numerals refer to like elements in the various figures, and wherein.

DETAILED DESCRIPTION

Figure 1:
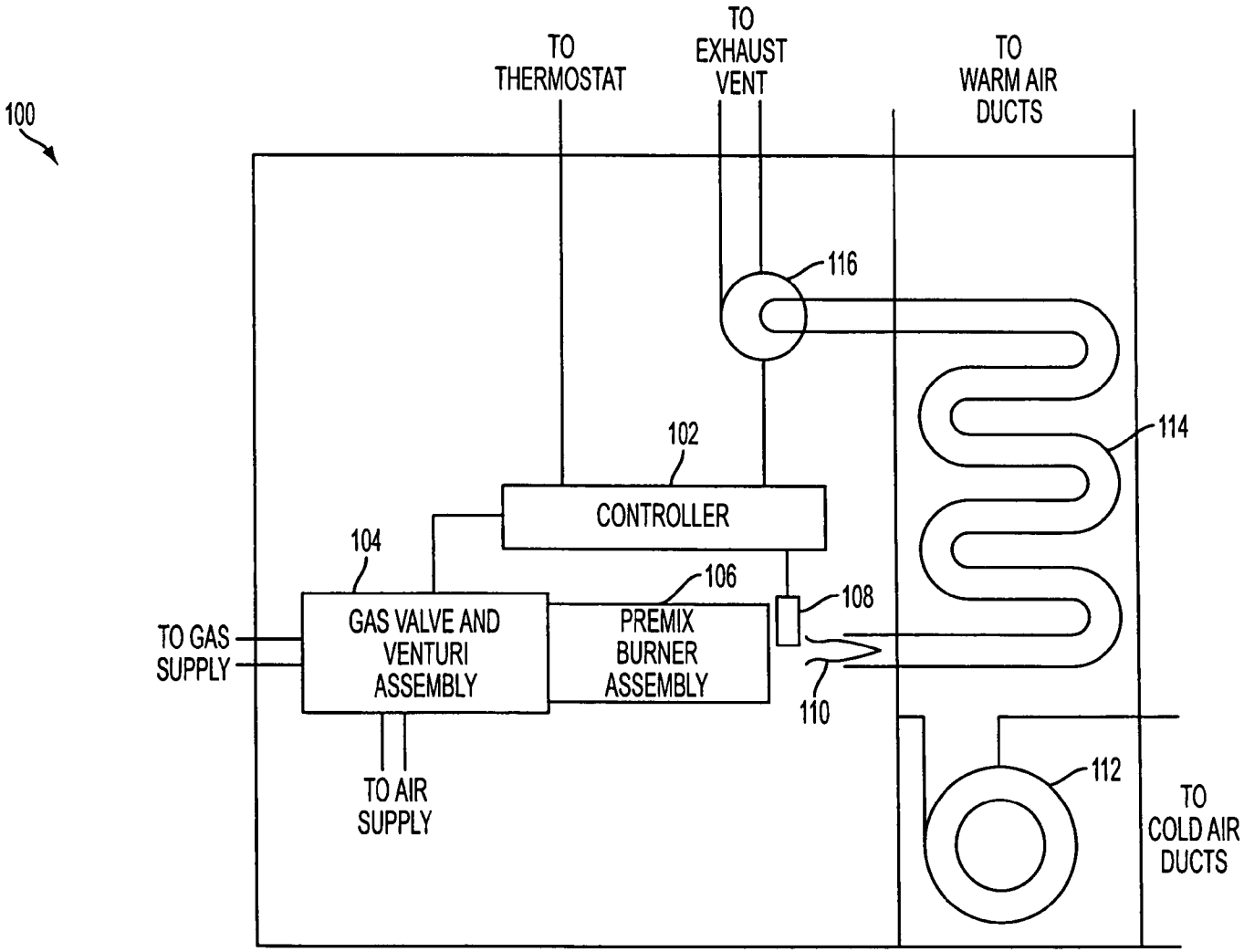
FIG. 1 is a block diagram of a warm air furnace, according to an exemplary embodiment.

FIG. 1 shows a simplified block diagram of a warm air furnace (WAF) 100. The WAF 100 includes a controller 102, a gas valve and venturi assembly 104, a premix burner assembly 106, an ignition element 108, a circulator fan 112, a heat exchanger 114, and a combustion air blower 116, which is also referred to as an inducer. The WAF 100 depicted in FIG. 1 is preferably fueled by a mixture of fuel, such as natural, propane or butane gas, and air (referred to hereinafter as "air-fuel premix"), that is mixed together via the gas valve and venturi assembly 104.

The WAF 100 may be connected to a thermostat, an exhaust vent, warm air or supply ducts, cold air or return ducts, a gas supply, and an air supply, as illustrated in FIG. 1. The WAF 100 may also be connected to an alternating current (AC) power supply. The WAF may have at least one AC load. For example, the ignition element 108 may be an AC hot surface ignition element, the fan 112 may include an AC permanent-split-capacitor (PSC) motor, and the inducer 116 may include an AC shaded-pole motor.

The WAF 100 may include additional components not shown in FIG. 1, such as sensors for detecting temperature and filters for trapping airborne dirt. Furthermore, WAFs have various efficiency ratings. Additional components may be necessary to achieve different levels of efficiency.

Generally, the WAF 100 operates as follows. The thermostat sends a "heat request" signal to the controller 102 when the thermostat is adjusted upwards. The controller 102 may perform a safety check. Once the safety check is completed, the controller 102 may activate the inducer 116 by turning on the AC shaded-pole motor. After turning on the AC shaded-pole motor, the air-fuel premix is then pulled by the inducer 116, via the heat exchanger 114, through the gas valve and venturi assembly 104 and into the premix burner assembly 106.

At that point, the controller 102 may then activate the ignition element 108. Upon activation, the ignition element 108 may ignite the air-fuel premix causing a flame 110 to develop. Once the flame 110 has been produced by the ignition element 108 and sensed by a flame sense rod (not shown in FIG. 1), the ignition element 108 may be deactivated. The flame 110 may warm metal in the heat exchanger 114.

After the heat exchanger 114 warms for a predetermined time, typically 15 to 30 seconds, the fan 112 may be activated. The fan 112 may direct cold air received from the cold air ducts into the heat exchanger 114. The heat exchanger 114 may separate the warm air from exhaust gases. The fan 112 may cause the warm air to exit the heat exchanger 114 through the warm air ducts, while the inducer 116 may cause the exhaust gases to exit through an exhaust vent connected to the outdoors.

The controller 102 may close off the fuel source for the gas valve and venturi assembly 104 when the thermostat setting has been reached. The inducer 116 may then be deactivated after a predetermined time period, such as 30 seconds, to ensure that the exhaust gasses have been removed from the heat exchanger 114. The fan 112 may also be deactivated after a predetermined time period, such as 120 seconds, to ensure the heat from the heat exchanger 114 is delivered to the warm air ducts. While the ignition element 108, the fan 112, and the inducer 116 are turned off, the WAF 100 may be in an idle mode.

A more detailed description of some of the components of the WAF 100 is described below, followed thereafter by a more detailed description of the operation of the WAF 100.

Gas Valve and Venturi Assembly

Figure 2:
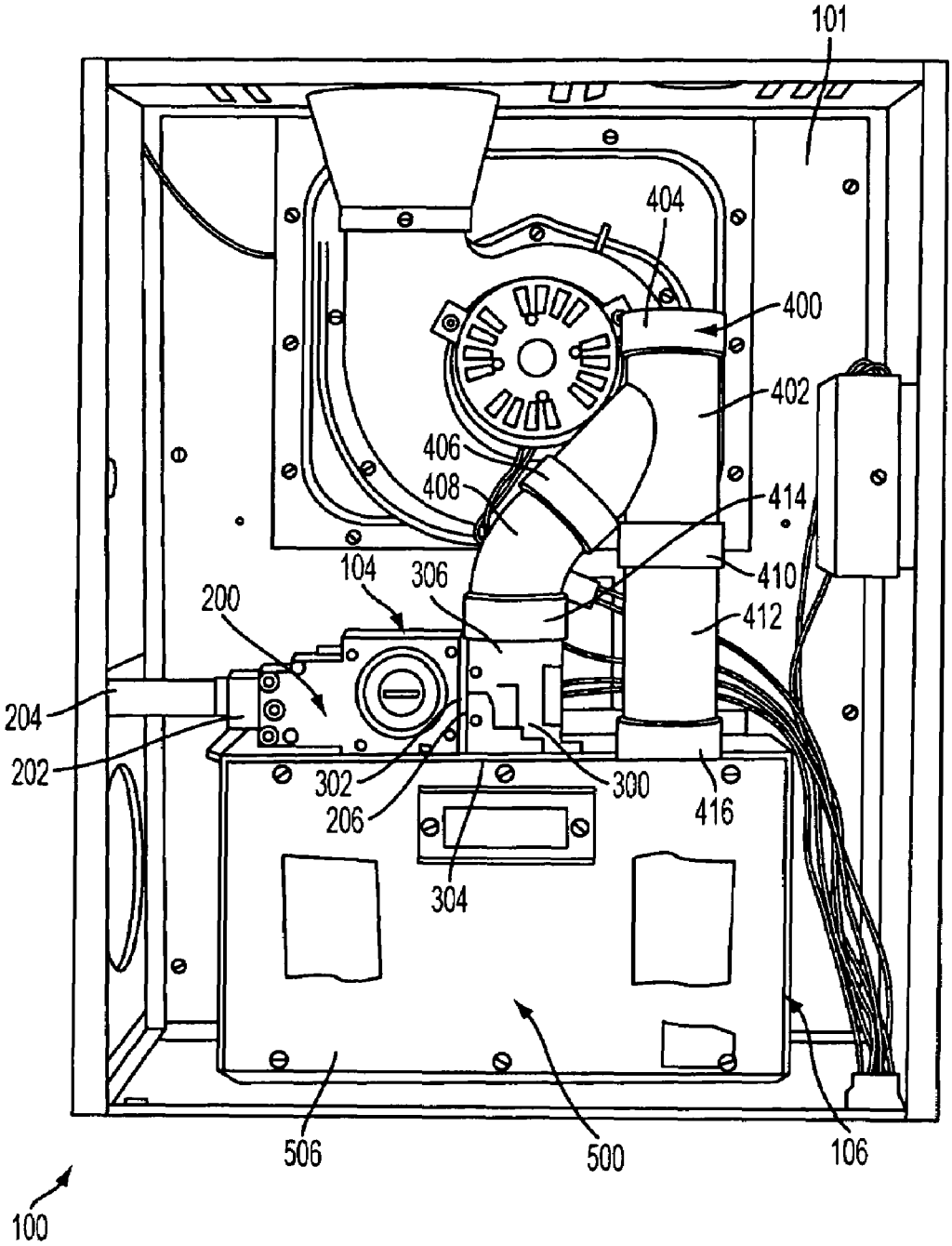
FIG. 2 is a front view of a exemplary vestibule of the warm air furnace of FIG. 1.

FIG. 2 shows an exemplary embodiment of the gas valve and venturi assembly 104 positioned within the vestibule 101 of the WAF 100. The assembly 104 comprises two primary components—a negative regulator or zero governor gas valve 200 and a venturi manifold 300. The valve 200 has a first end 202 connected to a fuel source, such as a natural, propane or butane gas pipe 204, and a second end 206 connected to the venturi manifold 300. The valve 200 may also be electrically connected to and controlled by the controller 102 (see FIG. 1). In addition, the valve 200 operates in such a manner as to allow the flow of fuel, such as natural, propane or butane gas, to pass into the venturi 300 only when a negative pressure is applied to the valve via a negative pressure source, such as the inducer 116.

The venturi 300 has a first end 302 connected to the second end 206 of the valve 200, and a second end 304 connected to the premix burner assembly 106. The venturi also preferably has a third end 306 that is connected to an air supply. These three connections allow the venturi 300 to receive fuel (e.g., natural, propane or butane gas) from the valve 200 connected at the first end and air from the air supply connected at the third end, and pass a mixture of the fuel and air (i.e., premix) to the premix burner assembly 106 at the second end.

The assignee of the present application manufactures and sells a gas valve and venturi assembly, Honeywell Model No. VK8115F, that is suitable for use with the WAF 100 described herein. This gas valve and venturi assembly is comprised of a negative regulator or zero governor gas valve, Honeywell Model No. VK8115V, and a venturi manifold, Honeywell Part No. 45.900.444. It should be understood, however, that other comparable valves and/or venturi may be used with the gas valve and venturi assembly 104 and the WAF 100 described herein. Moreover, the venturi may be replaced with other suitable furnace components for mixing air with fuel.

As shown in FIG. 2, the air supply may be brought to the venturi 300 via an air supply pipe 400. The air supply pipe 400 shown in FIG. 2 comprises a three-way connector pipe 402 having a first end 404 that is open to the air space within the vestibule 101 of the WAF 100. The three-way connector pipe 402 also comprises a second end 406 that is connected to an elbow pipe 408, and a third end 410 that is connected to a straight pipe 412. The elbow pipe 408 may in turn have an end 414 that is connected to the third end 306 of the venturi, and the straight pipe 412 may in turn have an end 416 that is connected to the premix burner assembly 106. As a result of this configuration for the air supply pipe 400, air may be supplied from the vestibule 101 of the WAF 100 to the assemblies 104, 106 through the open end 404 and the three pipes 402, 408, and 412.

While the air supply pipe shown in FIG. 2 will provide the air supply needed for the assemblies 104, 106, it should be understood that other air supply pipe configurations are suitable for use with the assemblies 104, 106 and the WAF 100 described herein. For example, instead of having a three-way connector, the air supply pipe may utilize a pair of two-way connectors, such that the assemblies 104, 106 each have their own independent air supply pipes. Moreover, rather than having the air supply for the air supply pipe(s) being supplied by the vestibule of the WAF, the open end(s) of the air supply pipe(s) may be vented or connected to an air supply outside of the WAF and its vestibule.

Premix Burner Assembly

Figure 3:
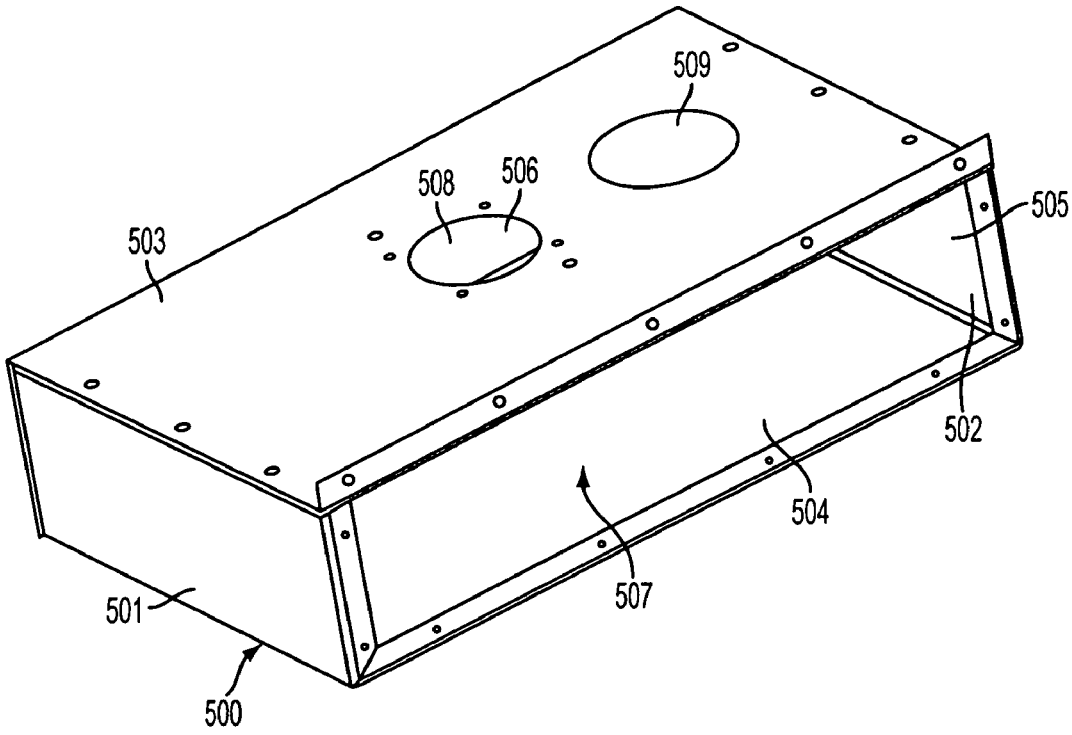
FIG. 3 is a perspective view of an exemplary cooling air box assembly for the warm air furnace of FIG. 1.

FIG. 2 shows an exemplary embodiment of the premix burner assembly 106 positioned within the vestibule 101 of the WAF 100. Preferably, the premix burner assembly 106 is designed to fit inside a standard WAF with minimal modification to the WAF. The premix burner assembly 106 comprises two primary components—a cooling air box assembly 500 (FIGS. 2 and 3) and a premix burner 600 (FIGS. 4*a*–4*c*).

The cooling air box assembly 500 comprises a box having a first side wall 501, a second side wall 502 opposite and spaced apart from the first side wall, a top wall 503 connecting the first and second side walls, a bottom wall 504 opposite and spaced apart from the top wall, a front opening 505 that faces the heat exchanger 114, and a back wall 506 (see FIGS. 2 and 3) that connects the top and bottom walls. The top wall 503 of the cooling air box assembly 500 also includes a first inlet opening 508 that is connected to the second end 304 of the venturi 300, and a second inlet opening 509 that is connected to the air supply pipe 400 (e.g., the end 416 of the straight pipe 412, as shown in FIG. 2).

The walls of the cooling air box assembly 500 define a cooling cavity 507 therein for receiving the premix burner 600 through the front opening 505. Preferably, the cooling cavity is sized large enough to allow air to circulate and flow around at least a portion of the premix burner (between the premix burner and the cooling air box assembly), when the premix burner is positioned in the cooling cavity. As explained below, the circulating air helps to cool the premix burner.

Figure 4A:
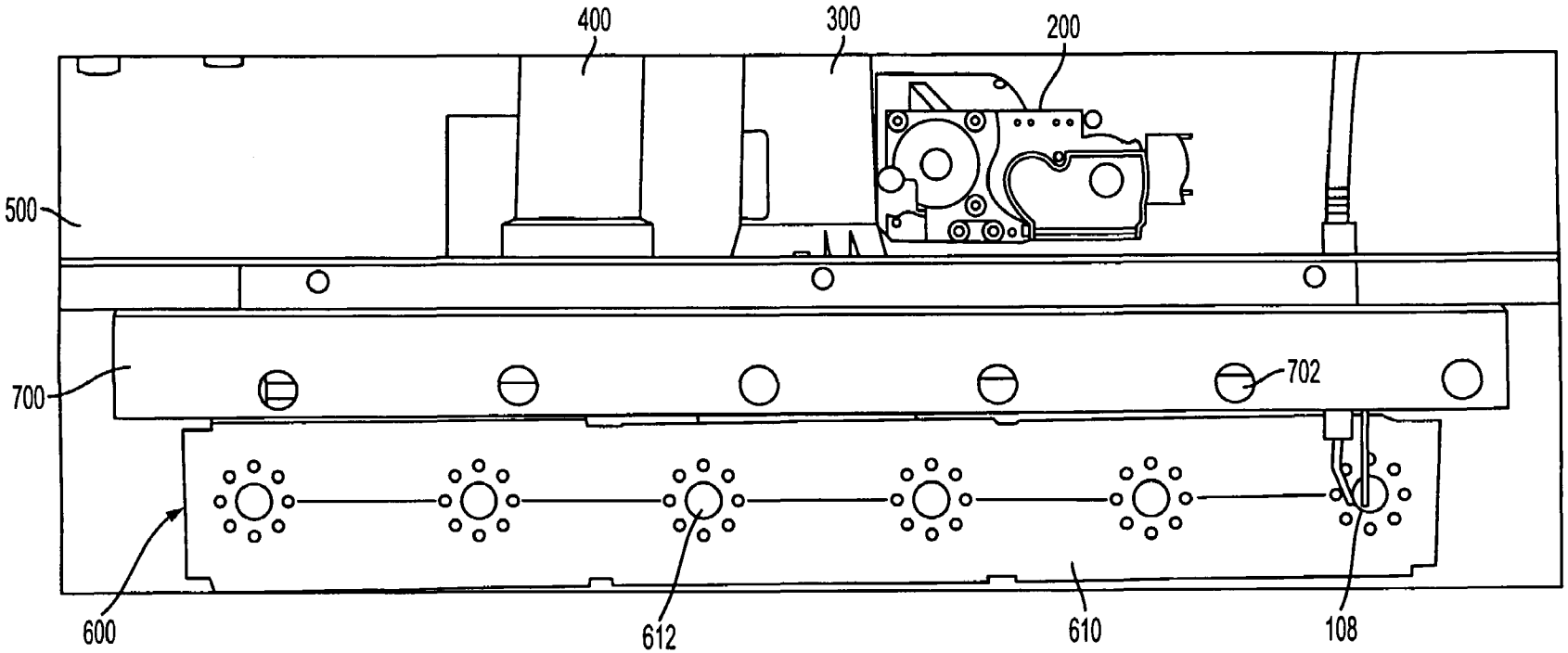
FIGS. 4*a*–4*c* are front, side, and back views, respectively, or an exemplary premix burner for the warm air furnace of FIG. 1.
Figure 4B:
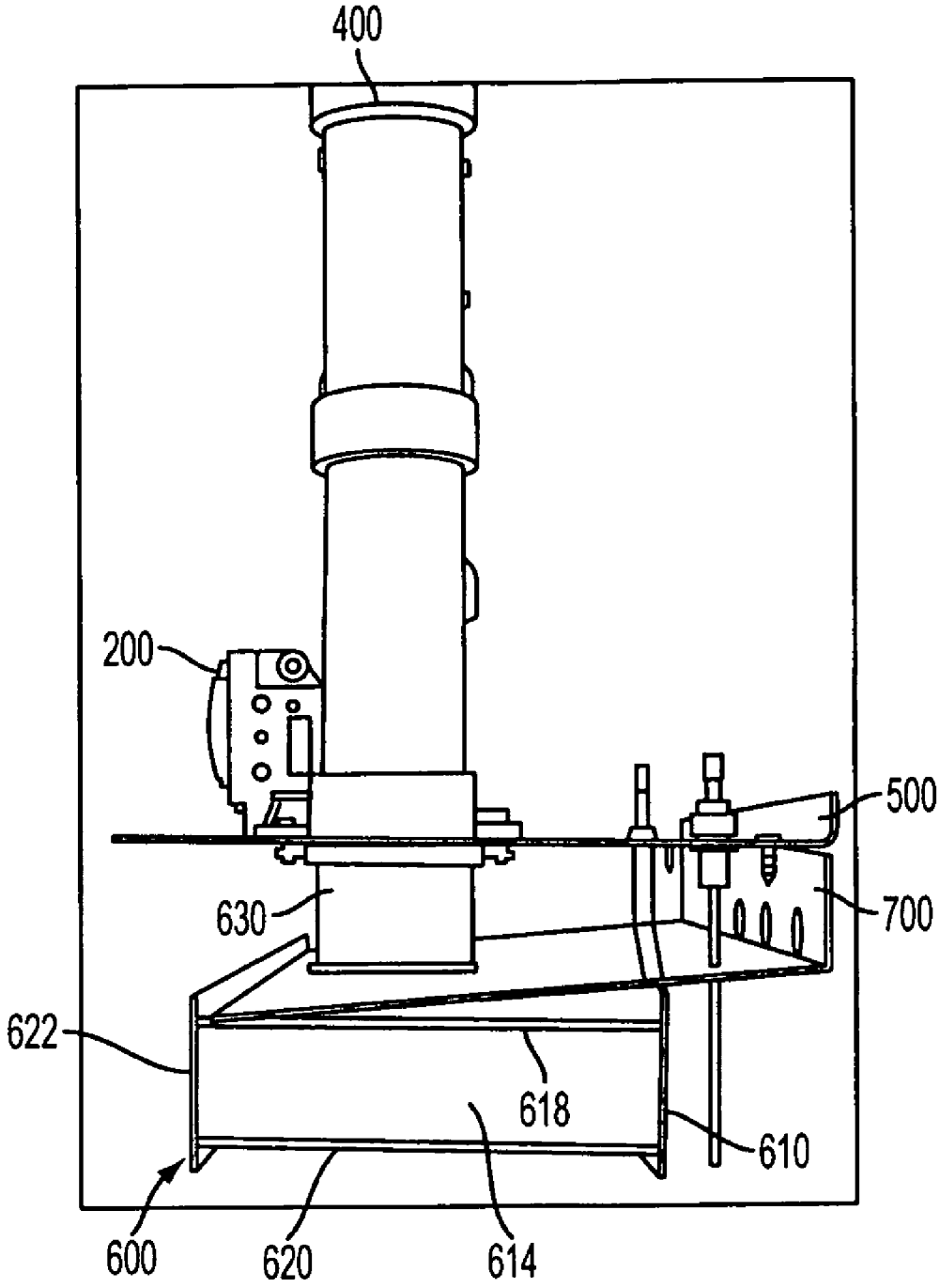
Figure 4C:
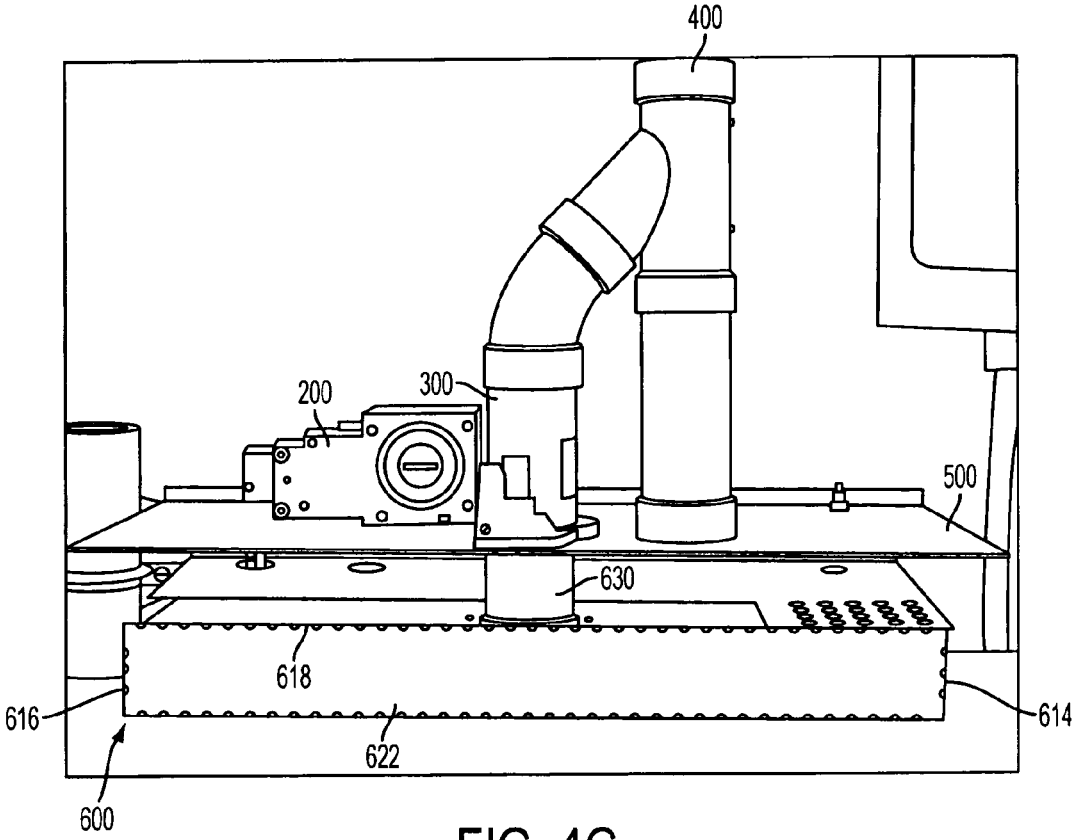

FIGS. 4*a*–4*c* illustrate an exemplary premix burner 600 for use with the WAF 100. The premix burner 600 comprises a burner face assembly 610 that has a plurality of burner holes 612 and that functions as a front wall for the premix burner. The premix burner 600 also comprises a first side wall 614, a second side wall 616 opposite and spaced apart from the first side wall, a top wall 618 connecting the first and second side walls, a bottom wall 620 opposite and spaced apart from the top wall, and a back wall 622 that connects the top and bottom walls. The walls of the premix burner together define a premix cavity 623 inside of them (see FIG. 9).

The top wall 618 may include an opening connected to and in communication with a premix connector 624. As shown in FIGS. 4*b*–4*c*, the premix connector 624 is preferably connected to and in communication with the first inlet opening 508 and the second end 304 of the venturi 300. The premix connector 624 provides the air-fuel premix to the premix cavity 623 of the premix burner 600 via the venturi 300.

Figure 5A:
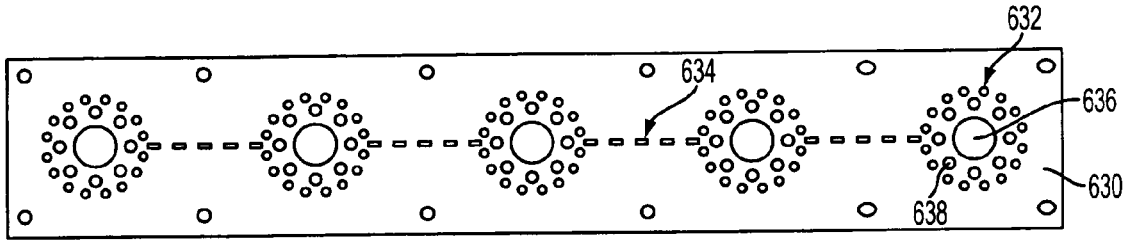
FIGS. 5*a*–5*c* are front views of an exemplary first burner face plate, second burner face plate, and third burner face plate, respectively, of an exemplary burner face assembly for the premix burner of FIGS. 4*a*–4*c;*
Figure 5B:
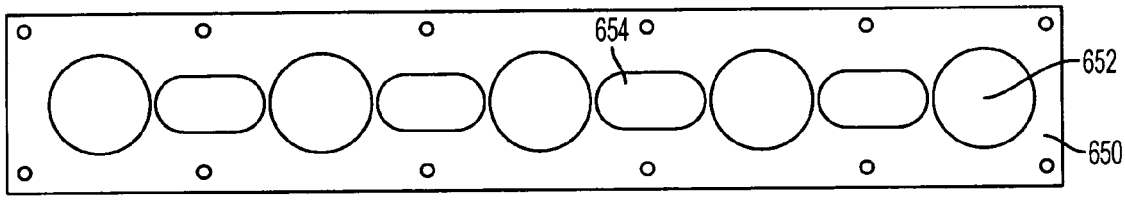
Figure 5C:
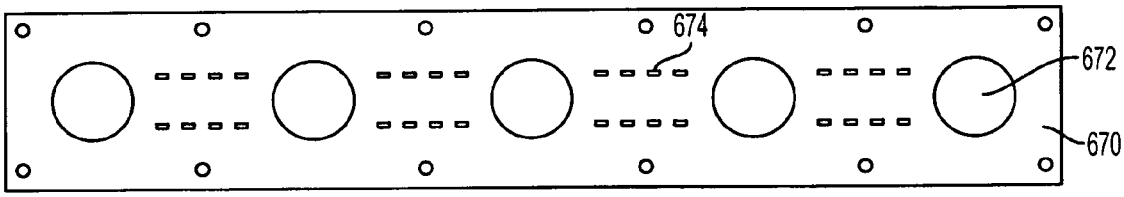

FIGS. 5*a*–5*c* illustrate exemplary plates for the burner face assembly 610. Preferably, the burner face assembly 610 comprises a first plate, such as burner face plate 630, a second plate, such as center restriction plate 650, and a third plate, such as rear restriction plate 670. Each of these plates 630, 650, and 670 are stacked one on top of the other (with the first plate being stacked on top of the second plate, which is stacked on top of the third plate) to form the burner face assembly 610 and the front wall of the premix burner 600. It is conceivable that these three plates may be integrated into a single plate design and/or that the burner face assembly 610 may be comprised of more or less than three plates.

As shown in FIG. 5*a*, the burner face plate 630 includes a plurality of burner openings 632 and a plurality of carry over openings 634 positioned between the burner openings. Each burner opening 632 preferably comprises an unrestricted main flow opening 636 surrounded by a plurality of restricted peripheral flow openings 638.

As shown in FIG. 5*b*, the center restriction plate 650 includes a plurality of central burner flow openings 652 and a plurality of central carry over flow openings 654 positioned between the central burner flow openings. Similarly, as shown in FIG. 5*c*, the rear restriction plate 670 includes a plurality of rear burner flow openings 672 and a plurality of rear carry over flow openings 674 positioned between the rear burner flow openings. The central burner flow openings 652 and the rear burner flow openings 672 are preferably aligned, centered, and in communication with each other and with the burner openings 632. Likewise, the central carry over flow openings 654 and the rear carry over flow openings 674 are preferably aligned, centered, and in communication with each other and with the carry over openings 634.

In the exemplary embodiment shown in FIGS. 5*a*–5*c* and described herein, the central burner openings 652 of the center restriction plate 650 are larger in diameter than the rear burner openings 672 of the rear restriction plate 670, and the rear burner openings 672 of the rear restriction plate 670 are larger in diameter than the burner openings 632 of the burner face plate 630. It should be understood, however, that other sizes, configurations, shapes and relative diameters may be implemented for the openings of the burner face assembly 610. It should also be understood that while five burner openings 632, central burner flow openings 652, and rear burner flow openings 672, and four sets of carry over openings 634, central carry over flow openings 654, and rear carry over flow openings 674, are shown in FIGS. 5*a*–5*c*, any different number of such openings may be used with the burner face assembly 610 described herein, depending on manufacturing preferences and operating parameters.

Figure 6:
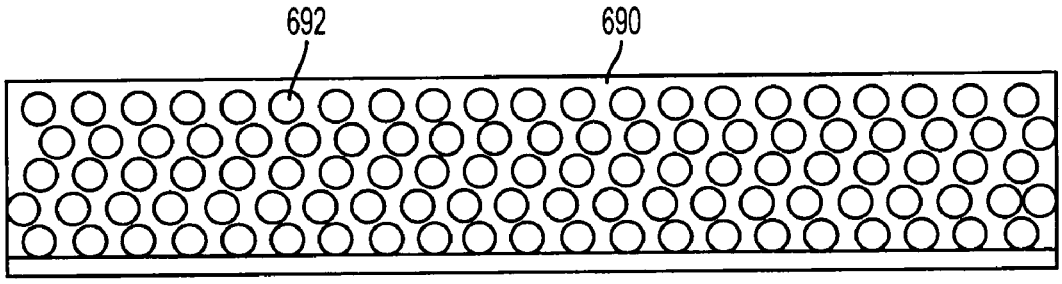
FIG. 6 is a front view of an exemplary diffuser plate for the premix burner of FIGS. 4*a*–4*c;*

FIG. 6 illustrates a premix flow distribution plate 690 that may be positioned within the premix cavity 623 between the burner face assembly 610 and the back wall 622 of the premix burner 600. The premix flow distribution plate 690 preferably has a plurality of distribution holes 692 to allow flow of air-fuel premix to flow through from the premix connector 624 to the burner face assembly 610. A variety of different number holes and hole configurations may be used with the premix flow distribution plate 690, depending on manufacturing preferences and operating parameters.

WAF Operation

Figure 7:
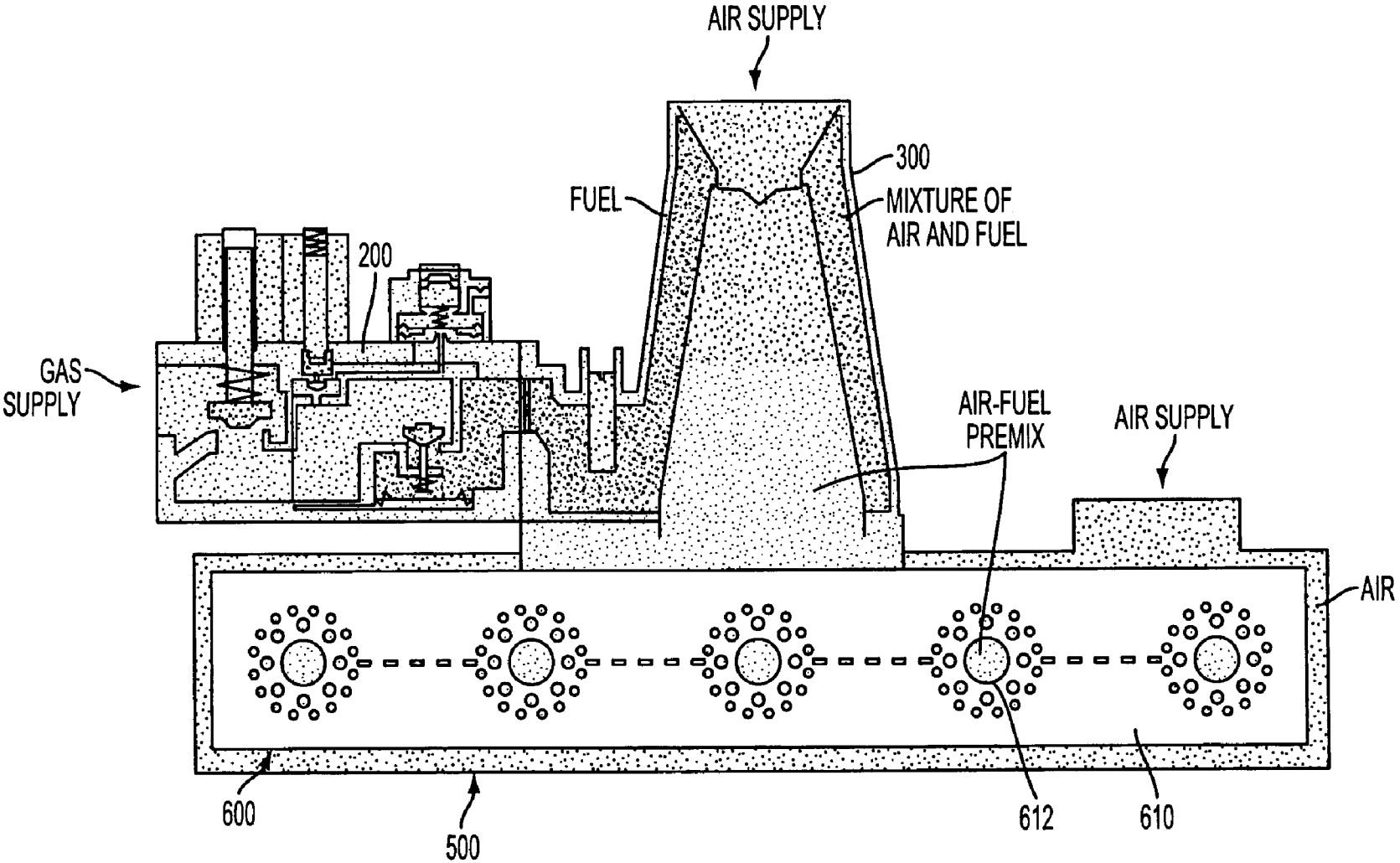
FIG. 7 is a schematic diagram illustrating the mixing of air and fuel in a venturi for the warm air furnace of FIG. 1, and the passing of that mixture through the premix burner of FIGS. 4*a*–4*c;*

The operation of the WAF 100 will now be described with reference to FIG. 7. A fuel, such as natural, propane or butane gas, is supplied to the valve 200 via a gas supply pipe, while air is supplied to the venturi 300 via an air supply pipe. When the inducer 116 is activated, a negative pressure is applied to both the valve and the venturi. As a result of this negative pressure, fuel (e.g., gas) is drawn through the valve and into the venturi. Air is also simultaneously drawn into the venturi via the air supply pipe 400 by the negative pressure caused by the inducer 116.

Once in the venturi, the fuel and air are mixed together to form an air-fuel premix. The air-fuel premix is then continued to be pulled through the venturi and into the premix burner assembly 106 by the negative pressure caused by the inducer. More specifically, the air-fuel premix is drawn into the premix cavity 623 of the premix burner 600 via the premix connector 624 that is connected to the venturi. Once in the premix cavity, the air-fuel premix is then drawn through the premix flow distribution plate 690 and out of the burner face assembly 610 (i.e., the front wall).

When the ignition element 108 is ignited by the controller 102, it creates a spark that lights the air-fuel premix exiting the burner hole 612 positioned closest to the ignition element. The flame created at this burner hole is then carried over to the other burner holes via the carry over openings 634. As a result, all of the burner holes of the burner face assembly produce a flame that extends into and heats the heat exchanger 114. By heating the heat exchanger, cold air from the cold air ducts that is blown across the heat exchanger by fan 112, may be warmed and supplied to the warm air ducts.

At the same time air-fuel premix is being drawn by the inducer 116 into the premix burner 600, cooling air is being drawn into the cooling air box assembly 500 via its second inlet opening 509 that is connected to the air supply pipe 400. Once in the cooling air box assembly 500, the cooling air may be further drawn around the premix burner 600 positioned in the cooling cavity 507, and then eventually out the front opening 505. The cooling air leaving the front opening 505 may also cool the entry region of the heat exchanger and provide additional air to complete the combustion process of the premix burner farther into the heat exchanger.

In order to more evenly distribute and improve this cooling air flow around the premix burner, a bypass flow distribution plate 700, with distribution holes 702 for passing and distributing the circulating cooling air, may be positioned between the premix burner and the cooling air box assembly, as best shown in FIG. 4*a*.

After the inducer is shutdown by the controller, fuel ceases to flow out from the valve and air is no longer drawn into the venturi or cooling air box assembly. With the air-fuel mixture no longer being supplied to the premix burner, the flames cease to exist and the heat exchanger is no longer heated.

Figure 8A:
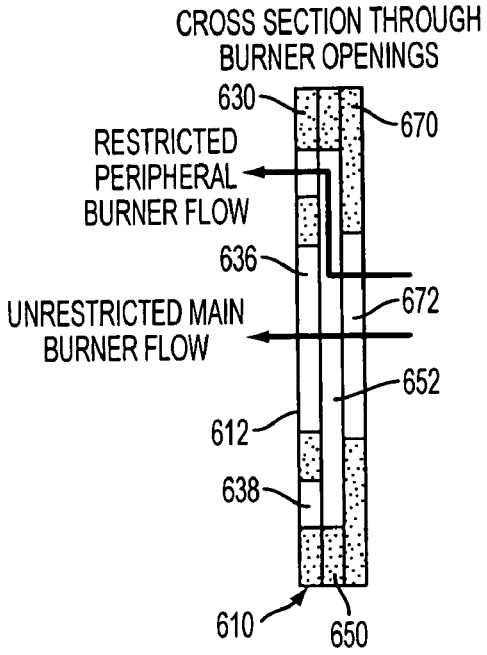
FIGS. 8*a*–8*b* are cross-sectional views of a burner opening and a carryover opening, respectively, of the burner face assembly of FIGS. 5*a*–5*c*.
Figure 8B:
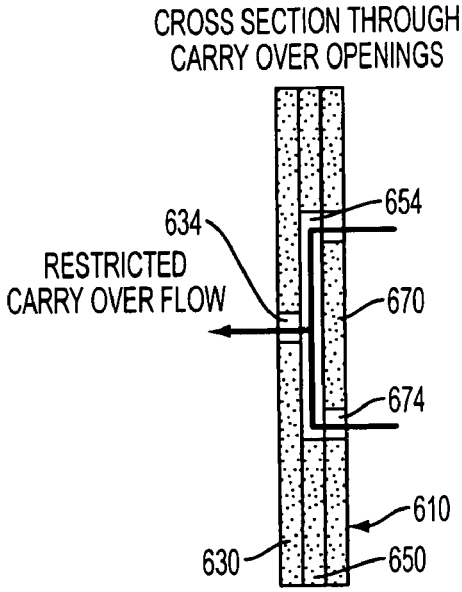

FIGS. 8*a*–8*b* illustrate the flow of air-fuel premix through the burner openings and the carry over openings, respectively. As shown in FIG. 8*a*, air-fuel premix from the premix cavity passes through the rear burner flow openings 672 of the rear restriction plate 670, into the central burner flow openings 652 of the center restriction plate 650, and out of both the unrestricted main flow opening 636 and the restricted peripheral flow openings 638. This configuration provides an extended length for the flames sprouting forth from the premix burner, yet maintains the shape and control of such flames.

As shown in FIG. 8*b*, air-fuel premix also flows from the premix cavity into the rear carry over flow openings 674 of the rear restriction plate 670, through the central carry over flow openings 654 of the center restriction plate 650, and out of the carry over openings 634 of the burner face plate 630. This restricted carry over flow of air-fuel premix through the carry over openings provides a way for other burner holes to be lit from the flame of a hole already lit, without interfering with any of burner hole flames or causing damage to the heat exchanger.

Figure 9:
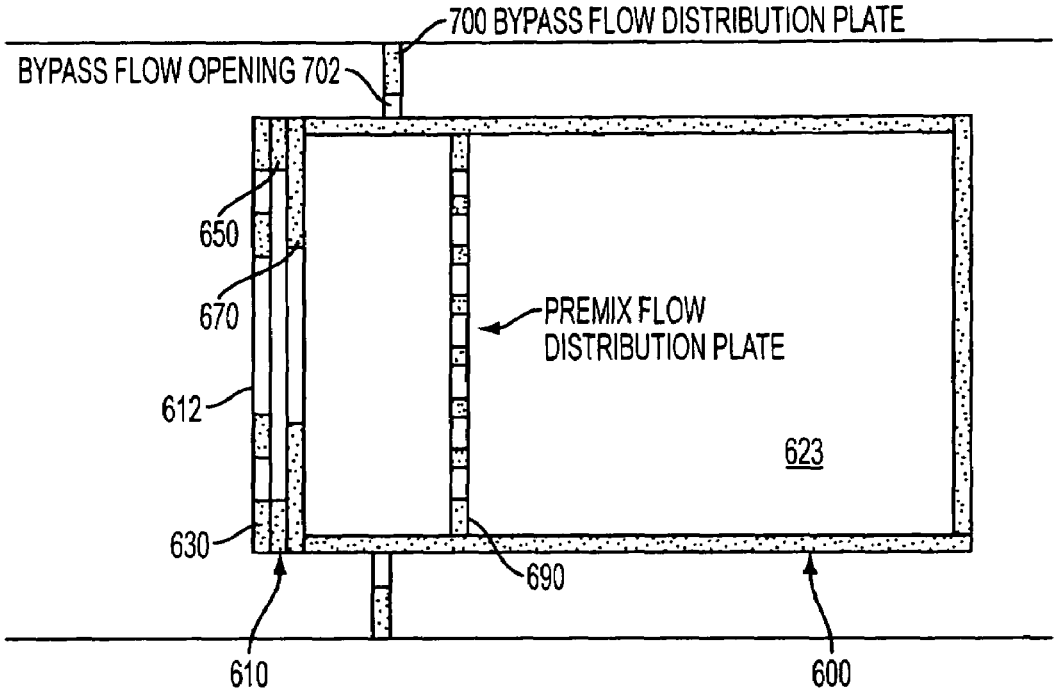
FIG. 9 is a cross-sectional view of the premix burner of FIGS. 4*a*–4*c* and the cooling air box assembly of FIG. 3.

FIG. 9 illustrates a cross-sectional view of the premix burner and the general flow of air-fuel premix through the burner. Air-fuel premix flows from the premix cavity 623 through the premix flow distribution plate 690, and is distributed via the distribution holes 692. Next, the distributed air-fuel premix is passed out of the burner face assembly as explained above and shown in FIG. 8*a*.

In addition to the air-fuel premix, cooling air is circulated around the premix burner and passed through the distribution holes 702 of the bypass flow distribution plate 700. The distribution holes 702 provide a more even distribution of the cooling air flow around the premix burner, thereby resulting in a more evenly cooled premix burner.

The WAF 100 and premix burner assembly 106 described herein have many advantages over prior art WAFs and inshot burners. For example, the premix burner 600 and its components are preferably made from sheet metal, thereby resulting in lower manufacturing costs. The premix burner 600 also has a low pressure drop due to its relatively large openings and minimal internal restrictions, while the burner face assembly 610 is relatively small so radiant energy heat transfer to the premix burner is reduced.

The physical configuration of the premix burner 600 is further advantageous in that the flame is shaped so excessive temperatures in the immediate vicinity of the premix burner are avoided. In addition, burner plenum and furnace bulkhead temperatures are kept low by pulling cooling air over the burner plenum and furnace bulkhead with the combustion air blower (i.e., inducer 116). This in turn makes it possible to use the premix burner assembly 106 in conjunction with a clamshell or tubular type heat exchanger with little or no modification to the heat exchanger. Moreover, the use of a negative regulator or zero governor gas valve 200 eliminates the need for a pressure switch, thereby enhancing the functionality and reliability of the furnace.

Finally, using a pneumatic air-fuel linked premix burner 600 as described in the present application provides four primary benefits: (1) prevention of condensation; (2) prevention of carbon monoxide production; (3) self-extinguishing of the flame below a minimum rate; and (4) a fuel rich condition that eliminates burner resonance.

It should be understood that the illustrated embodiments are exemplary only and should not be taken as limiting the scope of the present invention. The claims should not be read as limited to the described order or elements unless stated to that effect. Therefore, all embodiments that come within the scope and spirit of the following claims and equivalents thereto are claimed as the invention.

We claim:

1. A warm air furnace system comprising:

a negative regulator valve for controlling the flow of fuel;

a mixing component for receiving fuel from the valve and mixing the fuel with air to form an air-fuel premix;

a burner assembly for receiving the air-fuel premix from the mixer;

an inducer for pulling fuel through the negative regulator valve, for pulling air into the mixing component, and for pulling the air-fuel premix through the burner assembly;

an ignition element for igniting the air-fuel premix drawn from the burner assembly;

a heat exchanger in communication with and positioned between the burner assembly and the inducer; and a circulation fan for passing air over the heat exchanger;

wherein the air-fuel premix from the burner assembly that is ignited by the ignition element results in one or more flames, the one or more flames transfer heat to the heat exchanger, and the heat exchanger transfers heat to the air passed over the heat exchanger by the circulation fan.

2. The system of claim 1, wherein the burner assembly also receives air to cool the burner assembly.

3. The system of claim 2, wherein the mixing component is a venturi.

4. The system of claim 1, wherein the mixing component is a venturi.

5. The system of claim 1, wherein the fuel is natural, propane or butane gas.

6. The system of claim 1, wherein the burner assembly includes a premix burner positioned within and spaced apart from a cooling air box.

7. The system of claim 6, wherein the air-fuel premix is pulled into the premix burner by the inducer to be ignited into one or more flames, and air is pulled into the cooling air box by the inducer to cool the premix burner.

8. The system of claim 1, wherein the burner assembly includes a premix burner, and the premix burner has a burner face assembly, the burner face assembly comprises a first plate positioned on the top of a second plate, and a third plate on the bottom of the second plate.

9. The system of claim 8, wherein a premix flow distribution plate is positioned within the premix burner.

10. The system of claim 1, further comprising a bypass flow distribution plate, wherein the burner assembly includes a premix burner positioned within and spaced apart from a cooling air box, and the bypass flow distribution plate distributes the cooling flow of air surrounding the premix burner.

11. A warm air furnace system comprising:

a valve for controlling the flow of fuel;

a mixing component for receiving fuel from the valve and mixing the fuel with air to form an air-fuel premix;

a burner assembly having a premix burner positioned within a cooling air box, the premix burner receiving the air-fuel premix from the mixing component, the cooling air box receiving air for cooling the premix burner;

an inducer for pulling the air-fuel premix through the premix burner and for pulling air into the cooling air box;

an ignition element for igniting the air-fuel premix drawn from the premix burner;

a heat exchanger in communication with and positioned between the burner assembly and the inducer; and a circulation fan for passing air over the heat exchanger.

12. The system of claim 11, wherein the air-fuel premix from the premix burner that is ignited by the ignition element results in one or more flames, the one or more flames transfer heat to the heat exchanger, and the heat exchanger transfers heat to the air passed over the heat exchanger by the circulation fan.

13. The system of claim 11, wherein the valve is a negative regulator or zero governor gas valve.

14. The system of claim 13, wherein the mixing component is a venturi.

15. The system of claim 11, wherein the mixing component is a venturi.

16. The system of claim 11, wherein the premix burner has a burner face assembly, the burner face assembly comprises a first plate positioned on the top of a second plate, and a third plate on the bottom of the second plate.

17. The system of claim 11, wherein a premix flow distribution plate is positioned within the premix burner.

18. The system of claim 11, further comprising a bypass flow distribution plate to distribute the cooling flow of air in the cooling air box.

19. A warm air furnace system comprising:

a negative regulator valve for controlling the flow of fuel;

a venturi for receiving fuel from the negative regulator valve and mixing the fuel with air to form an air-fuel premix;

a burner assembly having a premix burner positioned within a cooling air box, the premix burner receiving the air-fuel premix from the venturi, the cooling air box receiving air for cooling the premix burner;

an inducer for pulling fuel through the negative regulator valve, for pulling air into the venturi, for pulling the air-fuel premix through the premix burners and for pulling the cooling air into the cooling air box;

an ignition element for igniting the air-fuel premix drawn from the premix burner;

a heat exchanger in communication with and positioned between the burner assembly and the inducer; and a circulation fan for passing air over the heat exchanger;

wherein the air-fuel premix from the premix burner that is ignited by the ignition element results in one or more flames, the one or more flames transfer heat to the heat exchanger, the heat exchanger transfers heat to the air passed over the heat exchanger by the circulation fan, and the cooling air pulled into the cooling air box flows around the premix burner.

* * * * *